US006708771B2

(12) United States Patent
Reilly

(10) Patent No.: US 6,708,771 B2
(45) Date of Patent: Mar. 23, 2004

(54) LOW PRESSURE ELECTRO-PNEUMATIC AND GATE ACTUATOR

(75) Inventor: William J. Reilly, Langhorne, PA (US)

(73) Assignee: Victaulic Company of America, Easton, PA (US)

( * ) Notice: Subject to any disclaimer, the term of this patent is extended or adjusted under 35 U.S.C. 154(b) by 288 days.

(21) Appl. No.: 10/060,441

(22) Filed: Jan. 30, 2002

(65) Prior Publication Data

US 2002/0121381 A1 Sep. 5, 2002

Related U.S. Application Data

(63) Continuation-in-part of application No. 09/897,167, filed on Jul. 2, 2001, which is a continuation-in-part of application No. 09/810,631, filed on Mar. 16, 2001, which is a continuation-in-part of application No. 09/535,599, filed on Mar. 27, 2000, now Pat. No. 6,293,348.

(51) Int. Cl.[7] ..... A62C 35/00; A62C 37/36

(52) U.S. Cl. ..... 169/16; 169/23; 169/17; 169/22; 169/42; 169/44

(58) Field of Search ..... 169/16, 17, 19–23, 169/14, 85, 44, 42; 251/61.2; 137/516.29, 527.8, 516.25, 516.9

(56) References Cited

U.S. PATENT DOCUMENTS

| | | | | |
|---|---|---|---|---|
| 1,613,343 | A | 1/1927 | Clark | |
| 1,863,454 | A | 6/1932 | Rowley | |
| 2,187,906 | A | 1/1940 | Lowe | 169/17 |
| 2,695,609 | A | 11/1954 | Nourse et al. | 128/142 |
| 2,731,091 | A | 1/1956 | Robbins | 169/17 |
| 2,822,052 | A | 2/1958 | Herkimer | 169/19 |
| 3,165,115 | A | 1/1965 | Erson | 137/494 |
| 3,476,353 | A | 11/1969 | Stampfli | 251/45 |
| 3,589,445 | A | 6/1971 | Juliano | 169/17 |

(List continued on next page.)

FOREIGN PATENT DOCUMENTS

| | | | |
|---|---|---|---|
| DE | 39 40 446 | 6/1990 | A47B/46/00 |
| FR | 2 334 032 | 7/1977 | F16K/17/36 |
| WO | WO 99/59678 | 11/1999 | A62C/37/06 |

OTHER PUBLICATIONS

U.S. patent application Ser. No. 09/526,250, filed Mar. 16, 2000, entitled Dry Accelerator for Sprinkler System (Reilly).

U.S. patent application Ser. No. 09/810,723, filed Mar. 16, 2001, entitled "Low Pressure for Dry Sprinkler System" (Reilly).

U.S. patent application Ser. No. 09/810,631, filed Mar. 16, 2001, entitled "Low Pressure Actuator for Dry Sprinkler System" (Reilly).

U.S. patent application Ser. No. 09/897,167, filed Jul. 2, 2001, entitled "Low Pressure Pneumatic and Gate Actuator" (Reilly).

*Primary Examiner*—Davis Hwu
(74) *Attorney, Agent, or Firm*—Synnestvedt & Lechner LLP

(57) ABSTRACT

An electro-pneumatic actuator having AND gate logic characteristics is disclosed. The actuator has three chambers each divided into two chamber portions by respective flexible diaphragms. One of the diaphragms acts as a valve closing member and controls the flow of a pressurized fluid through the actuator to actuate an associated device when fluid flow is permitted. The other two diaphragms are in mechanical contact with one another and in hydraulic communication with the one diaphragm and thereby control its motion, keeping it normally closed and preventing fluid flow but allowing it to move into an open position permitting fluid flow and actuation of the associated device only when each of the two diaphragms are subject to separate, concurrent drops in pressure which allows both of them to deflect away from the one diaphragm. One of the pressure drops is triggered pneumatically, the other electrically.

36 Claims, 4 Drawing Sheets

U.S. PATENT DOCUMENTS

| | | | | | |
|---|---|---|---|---|---|
| 3,595,318 | A | | 7/1971 | Merdinyan | 169/17 |
| 3,727,878 | A | | 4/1973 | Willms | 251/57 |
| 3,785,440 | A | | 1/1974 | Shea | 169/20 |
| 3,788,400 | A | | 1/1974 | Tufts | 169/11 |
| 4,286,668 | A | | 9/1981 | McCormick | 169/22 |
| 4,570,719 | A | | 2/1986 | Wilk | 169/20 |
| 4,615,353 | A | | 10/1986 | McKee | 137/102 |
| 4,854,342 | A | | 8/1989 | Polan | 137/516.29 |
| 4,991,548 | A | * | 2/1991 | Richeson et al. | 123/90.14 |
| 5,096,266 | A | | 3/1992 | Skantar | 303/82 |
| 5,294,090 | A | | 3/1994 | Winnike | 251/36 |
| 5,439,028 | A | | 8/1995 | Meyer et al. | 137/556 |
| 5,628,489 | A | * | 5/1997 | Woodman | 251/29 |
| 5,899,277 | A | | 5/1999 | Eisenbeiss et al. | 169/46 |
| 6,000,473 | A | | 12/1999 | Reilly | 169/17 |
| 6,029,749 | A | | 2/2000 | Reilly et al. | 169/17 |
| 6,068,057 | A | | 5/2000 | Beukema | 169/22 |
| 6,138,766 | A | | 10/2000 | Finnerty et al. | 169/14 |
| 6,158,520 | A | | 12/2000 | Reilly et al. | 169/17 |
| 6,293,348 | B1 | | 9/2001 | Reilly | 169/16 |

* cited by examiner

LOW PRESSURE ELECTRO-PNEUMATIC AND GATE ACTUATOR

RELATED APPLICATIONS

This is a continuation-in-part of U.S. application Ser. No. 09/897,167, filed Jul. 2, 2001, which is a continuation-in-part of U.S. application Ser. No. 09/810,631, filed Mar. 16, 2001, which is a continuation-in-part of U.S. application Ser. No. 09/535,599, filed Mar. 27, 2000, now U.S. Pat. No. 6,293,348 issued Sep. 25, 2001.

FIELD OF THE INVENTION

This invention relates to actuators for controlling the operation of valves and especially for valves used in sprinkler systems for fire protection.

BACKGROUND OF THE INVENTION

Automatic sprinkler systems for fire protection of structures such as office buildings, warehouses, hotels, schools and the like are required when there is a significant amount of combustible matter present. The combustible matter may be found in the materials from which the building itself is constructed, as well as in the building contents, such as furnishings or stored goods.

Of the various types of automatic sprinkler systems available, the preaction systems find widespread use. Preaction systems use an actuator which responds to a combination of signals from different detectors to trip a valve which provides water to the sprinkler piping network. Similar to the so-called "dry-pipe" systems, the piping network in the preaction system is normally filled with air or nitrogen (and not water) prior to actuation. The preaction system can thus be used in unheated environments which are subject to below freezing temperatures without fear of pipes bursting due to water within the pipes expanding upon freezing.

When sufficiently pressurized, the behavior of the gas within the piping network may be used to indicate a fire condition and trigger actuation of the preaction system. Heat from the fire will cause sprinkler heads to open, allowing pressurized gas to escape from the piping network and result in a pressure drop within the system. Actuation of the system may be effectively triggered by this pressure drop.

Specifically, double interlock preaction systems are further advantageous because an alarm may be sounded to provide a warning before the sprinklers operate. Furthermore, failure, breakage or accidental opening of the sprinklers or a pipe in the piping network will not result in an unintentional discharge of water, since there is no water in the network until the system is actuated. Actuation for double interlock preaction systems requires that two or more separate signals be sensed by the actuator.

Preaction systems are not without their disadvantages however. Traditional preaction systems, described above, which are triggered by a drop in air pressure within the piping network as the result of a sprinkler head opening in response to heat (along with a confirming signal from another sensor) usually maintain the sprinkler piping network at a relatively high internal pressure, typically on the order of 20% of the maximum water pressure in the system. The air pressure in such systems is used to control the release of the water to the piping network, and the valves typically operate at a mechanical advantage of about 1 to 5 air pressure to water pressure. The use of relatively high-air pressures becomes a problem with larger systems which tend to have a relatively large volume of air within the piping network. Higher air pressures and volumes require more powerful compressors, having higher capital and operating costs. Furthermore, the higher pressures mean that more air must be forced out of the piping network upon activation. The air in the network inhibits the free flow of water and, thus, increases the reaction time of the system. More air in the piping network also means that more moisture will be present, accelerating corrosion of the pipes.

There is clearly a need for a preaction sprinkler system having the ability to operate at relatively low system air pressures for providing a signal which activates the sprinkler system.

SUMMARY AND OBJECTS OF THE INVENTION

The invention concerns an electro-pneumatic actuator for actuating a fire sprinkler system. The system is actuated when the actuator depressurizes a piston holding a valve controlling the flow of water to the sprinkler system closed. The actuator behaves like an AND gate in a logic circuit in that it will depressurize the piston and release the valve only when two separate signals indicating a fire condition are manifest in the actuator. The actuator is, thus, connected to two separate fire detection systems, one being the piping network of the sprinkler system charged with compressed gas, the other being an electronic fire detection system having a control system in communication with a plurality of fire detectors substantially co-located with the piping network.

During a fire, heat-sensitive sprinkler heads on the piping network open and release pressurized air within the network to the ambient causing a pressure drop in the piping network. Because the piping network is in fluid communication with the actuator, the pressure drop is sensed by it. The pressure drop is accompanied by a signal or signals indicating a fire condition sent from one or more of the fire detectors to the control system. In turn, the control system sends an electrical signal to the actuator. In response to the concurrent pressure drop in the piping network and the electrical signal from the control system, the actuator depressurizes the piston which allows the valve to open and supply water to the piping network for release through the open sprinkler heads onto the fire.

In the preferred embodiment, the actuator has a first chamber with a flexible first diaphragm mounted therein. The first diaphragm sealingly divides the first chamber into first and second chamber portions, both the chamber portions being in fluid communication with the cylinder. The second chamber portion has an opening providing fluid communication with the ambient, the opening being surrounded by a seat facing the first diaphragm. The first diaphragm is deflectable into sealing engagement with the seat to seal the opening when the cylinder is pressurized with a first fluid, such as the water for the sprinkler system.

A second chamber having a flexible second diaphragm mounted therein which sealingly divides the second chamber into third and fourth chamber portions is preferably positioned above the first chamber. The third chamber portion is in fluid communication with a source of pressurized second fluid, for example, the compressed air within the piping network, and the fourth chamber portion is in fluid communication with the ambient. The fourth chamber portion has an aperture providing fluid communication with the first chamber portion, the aperture being surrounded by a second seat facing the second diaphragm. The second diaphragm is deflectable into sealing engagement with the second seat to seal the aperture when the third chamber portion is pressurized with the second fluid, for example, the compressed air from the piping network.

A third chamber having a flexible third diaphragm mounted therein which sealingly divides the third chamber into fifth and sixth chamber portions is preferably mounted atop the second chamber. The fifth chamber portion is in fluid communication with the pressurized first fluid. An elongated plunger extends between the fifth and third chamber portions. One end of the plunger is positioned within the sixth chamber portion and is engageable with the third diaphragm, the other end of the plunger being positioned within the third chamber portion and engageable with the second diaphragm. The third diaphragm is deflectable into engagement with the one end of the plunger when the fifth chamber portion is pressurized with the pressurized first fluid. The plunger is forced into engagement with the second diaphragm and thereby forces the second diaphragm into sealing engagement with the second seat.

A passageway is located within the third chamber providing fluid communication between the fifth chamber portion and the ambient. A valve is engaged with the passageway and has a valve member movable between an open position, allowing fluid flow through the passageway and a closed position, preventing fluid flow through the passageway. The valve also has means for biasing the valve member into the closed position and an electrically operated actuator for moving the valve member into the open position upon receipt of the electrical signal form the control system.

In operation, the second diaphragm is deflected out of engagement with the second seat only when fluid pressures in both the fifth and the third chamber portions are lowered to respective predetermined values, pressure in the fifth chamber portion being lowered by electrically actuating the valve member into the open position, pressure in the third chamber portion being lowered by a drop in pressure of the pressurized second fluid. Upon deflection of the second diaphragm, pressurized first fluid in the first chamber portion is permitted to enter the fourth chamber portion and exit to the ambient, thereby allowing the first diaphragm to deflect out of engagement with the first seat. This allows the pressurized first fluid to flow from the cylinder through the second chamber portion and exit to the ambient, thereby depressurizing the piston and allowing it to move within the cylinder to release the valve and actuate the sprinkler system.

The invention also includes a reset valve for manually resetting the sprinkler system and preventing unintentional resetting during a fire. The reset valve has a valve body and a conduit extending through the valve body. One end of the conduit is in fluid communication with the third chamber portions and the other end is vented to the ambient. A valve seat is positioned in the one end of the conduit and a valve closing member is movably mounted within the conduit adjacent to the seat. The valve closing member is movable into sealing engagement with the seat to close the reset valve. The reset valve also has means for biasing the valve closing member out of engagement with the seat when fluid pressure within the one end of the conduit falls below a predetermined value. The biasing means thereby opens the reset valve and vents the third chamber portion to the ambient. Preferably, there is an identical reset valve in fluid communication with the fifth chamber portion as well. The reset valves prevent spurious pressure surges from pressurizing either of the third or fifth chamber portions and thereby accidentally resetting the system and, thus, cutting off the water supply during a fire.

It is an object of the invention to provide an actuator for a double interlock fire protection sprinkler system which uses pneumatic and electrical functions to actuate the system.

It is another object of the invention to provide an actuator, wherein the pneumatic function operates substantially independently of the system water pressure.

It is yet another object of the invention to provide an actuator which will not trigger the system in the event of an electrical power failure.

It is again another object of the invention to provide an actuator which will not reset itself during a fire due to an air pressure surge.

These and other objects of the invention will be apparent upon consideration of the following drawings and detailed description of the preferred embodiments.

DETAILED DESCRIPTION OF THE PREFERRED EMBODIMENTS

Figure 1:
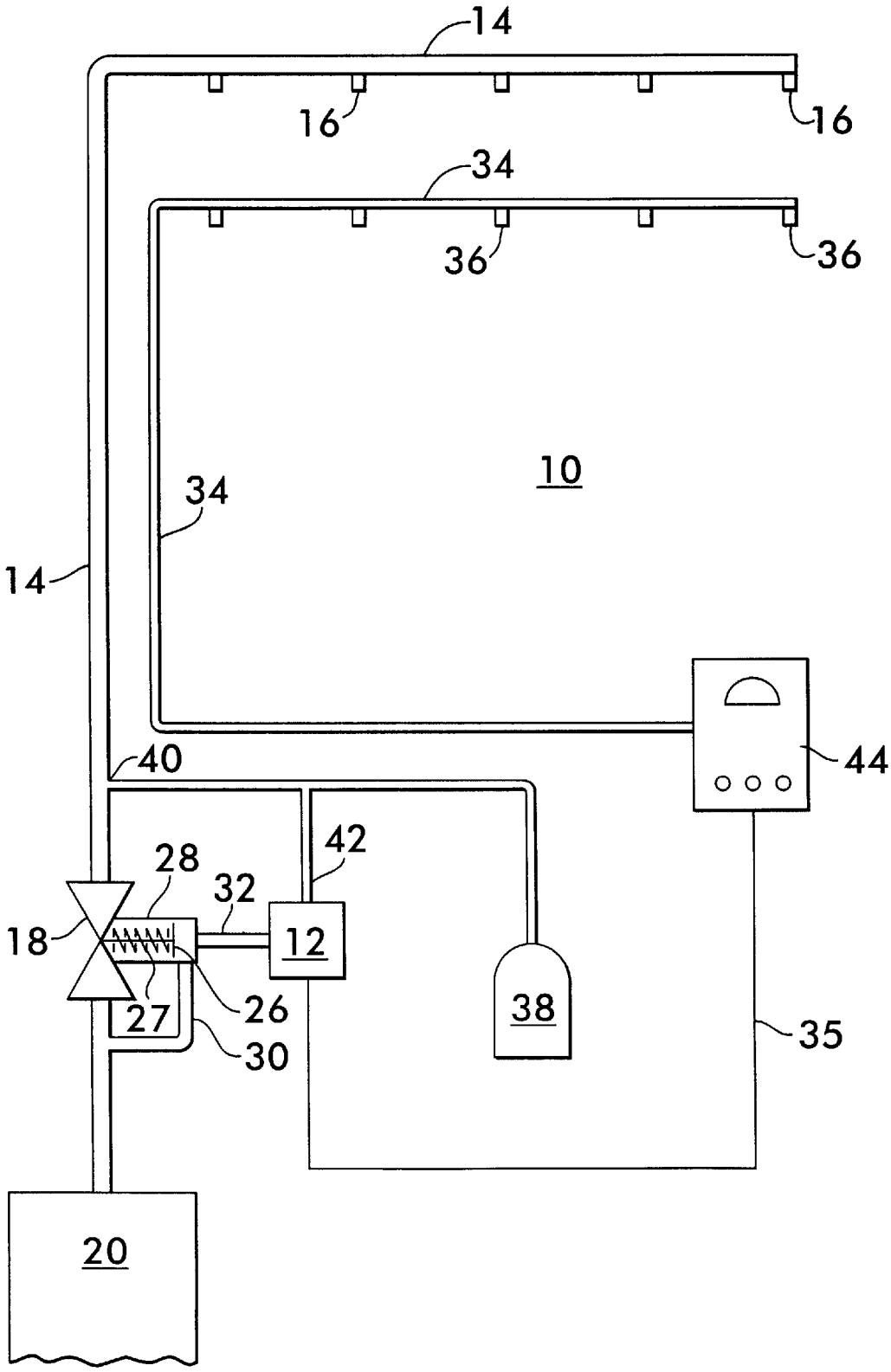
FIG. 1 is a schematic depiction of a preaction double interlock fire protection sprinkler system using a low pressure electro-pneumatic AND gate actuator according to the invention.

FIG. 1 shows a double interlock preaction fire protection sprinkler system 10 having a low pressure AND gate electro-pneumatic actuator 12 according to the invention. System 10 comprises a piping network 14 having a plurality of automatic sprinkler heads 16 which open when the air surrounding the head reaches a predetermined temperature due to a fire. Network 14 is normally dry and is connected to a valve 18 which controls the flow of water from a pressurized water supply source 20 to the network 14.

Figure 2:
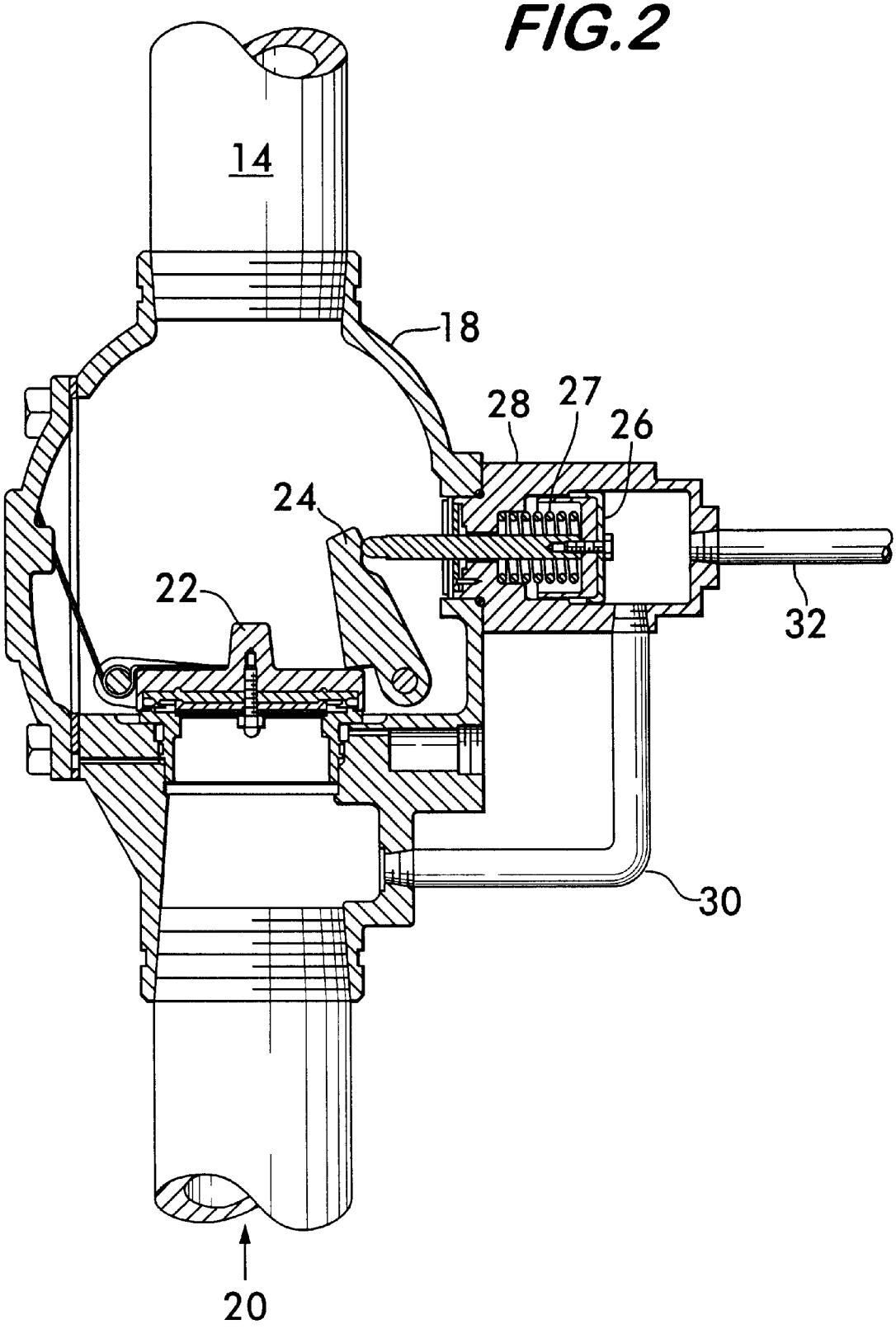
FIG. 2 is a longitudinal sectional view of a valve and control piston used in the preaction fire protection system shown in FIG. 1.

As shown in FIG. 2, the valve closing member of valve 18 is preferably a pivoting clapper 22 held in the closed position against the pressure of the water supply 20 by a latch 24 controlled by a piston 26 reciprocable within a cylinder 28. Cylinder 28 is in fluid communication with water supply 20 via a conduit 30, the water supply 20 pressurizing piston 26 against compression spring 27 to hold the latch in position keeping the clapper 22 closed. As shown in both FIGS. 1 and 2, cylinder 28 is also in fluid communication with the electro-pneumatic actuator 12 via a conduit 32, the actuator hydraulically controlling the action of the piston 26 to actuate valve 18 as described below. The piping network 14 is in fluid communication with a compressed air supply 38 at a point 40 downstream of the clapper 22. The piping network 14 is also connected to the electro-pneumatic actuator 12 via a conduit 42 as described in detail below.

As further shown in FIG. 1, sprinkler system 10 also includes a plurality of fire detectors 36. Detectors 36 are substantially co-located with sprinkler heads 16 and may be virtually any type of transducer which detects a fire condition and generates an electrical signal in response thereto. For example, detectors 36 may detect smoke, heat, rate of temperature rise, visible, infra-red or ultra-violet light and generate an electrical signal in response. The signal is transmitted via a communication link 34 to a control system 44. Preferably, control system 44 is a microprocessor which receives electrical signals from one or more of the detectors 36 indicating a fire condition and in response sends an electrical signal to the electro-pneumatic actuator 12 via another communication link 35.

In operation, both the piping network 14 and the detectors 36 act as sensors to trigger the sprinkler system 10 in the event of a fire. The piping network 14 is charged with compressed air from the compressed air supply 38. Heat from the fire causes the automatic sprinkler heads 16 nearest the fire to open. Substantially concurrently, detectors 36 nearest the fire sense its presence and generate a signal which is sent to the control system 44 via communication link 34. Opening of the heads 16 of the piping network 14 permits a drop in the pressure of the compressed air in the network which is communicated to the electro-pneumatic actuator 12 through conduit 42. In response to the signal from the detectors 36, control system 44 sends an electrical signal to the electro-pneumatic actuator through communication link 35. Upon receiving the combination of the pressure drop within the piping network 14 and the electrical signal from the control system 44, the electro-pneumatic actuator 12 depressurizes piston 26 which, under the biasing force of spring 27 releases latch 24 permitting clapper 22 to open and supply water to the piping network 14. Upon reaching the open sprinkler head or heads 16, the water is discharged onto the fire. The operation of the electro-pneumatic actuator 12 is described in detail below.

Figure 3:
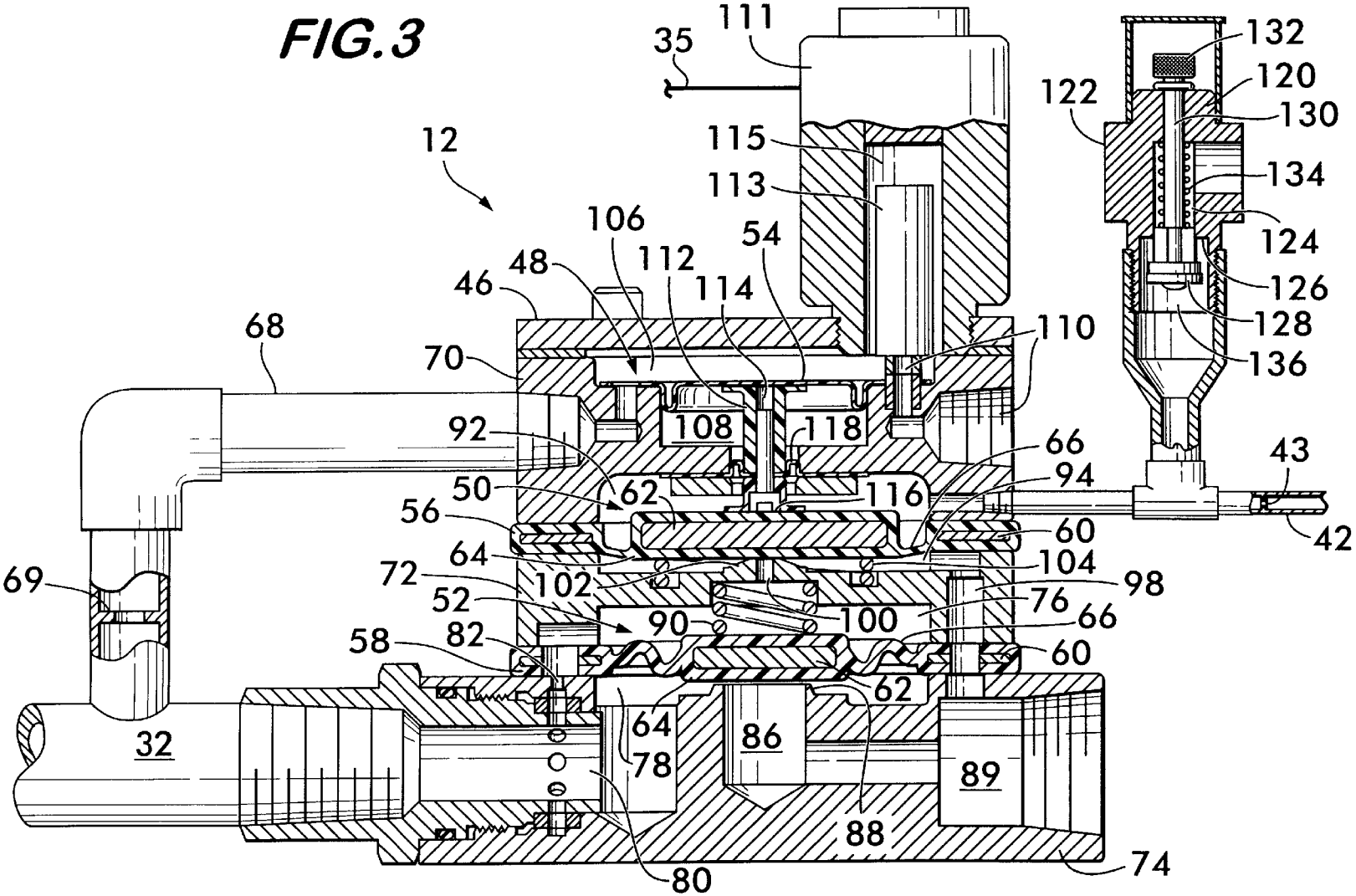
FIG. 3 is a longitudinal sectional view of a low pressure electro-pneumatic AND gate actuator according to the invention.

As shown in cross-section in FIG. 3, the low pressure electro-pneumatic actuator 12 has a housing 46 preferably comprised of brass. Housing 46 has three chambers, a top chamber 48, a middle chamber 50 and a bottom chamber 52. Although the chambers are shown positioned one above another and are named top, middle and bottom, it is understood that the orientation of the actuator is irrelevant to its operation and the naming of its parts is for convenience and by way of example only and places no limitations on the structure or configuration of the actuator.

Each chamber is divided into upper and lower chamber portions by respective top, middle and bottom diaphragms 54, 56 and 58. Preferably, diaphragms 56 and 58 comprise a metal ring 60 surrounding a metal plate 62. Both the plate 62 and ring 60 are encapsulated in a flexible sheath 64 and are attached to one another by a membrane portion 66 of the sheath 64 which extends between the plate and the ring. Ring 60 stiffens the perimeter of the diaphragm and provides a means for attaching it to the housing, the ring being sandwiched between various segments 70, 72 and 74 forming the housing. The sheath is preferably EPDM or a similar flexible polymer and provides for a fluid tight seal between the segments. Plate 62 stiffens the diaphragm and the sheath surrounding it ensures a fluid tight seal between the diaphragm and various seats as described below. The membrane portion 66 provides flexibility allowing the diaphragm to deflect in response to fluid pressure on one side or another.

Top diaphragm 54 is preferably a simple membrane which performs a sealing function between the upper and lower chamber portions of the top chamber 48.

While the diaphragms as described above are preferred, it is understood by those of skill in the art that other types of diaphragms may also be used without adversely affecting the operation of the actuator.

Bottom chamber 52 is divided by bottom diaphragm 58 into an upper chamber portion 76 and a lower chamber portion 78. Both chamber portions 76 and 78 are in fluid communication with cylinder 28 through conduit 32. Conduit 32 has a large diameter duct 80 which connects with the lower chamber portion 78 and a smaller diameter duct 82 which connects to the upper chamber portion 76. Lower chamber portion 78 has a hole 86 surrounded by a seat 88, the hole 86 allowing the lower chamber portion to vent to the ambient through a port 89, the seat 88 being engageable by the bottom diaphragm 58 to seal the hole 86 when the force exerted by the pressure in the upper chamber portion 76 is greater than the force exerted by the pressure in the lower chamber portion 78. Preferably, a biasing means in the form of a spring 90 is positioned within upper chamber portion 76 to bias bottom diaphragm 58 into sealing engagement with seat 88.

Middle chamber 50 is divided into upper and lower chamber portions 92 and 94 respectively by middle diaphragm 56. Upper chamber portion 92 is in fluid communication with piping network 14 through conduit 42 (see also FIG. 1), and lower chamber portion 94 is in fluid communication with the ambient through a duct 98 connecting to port 89. Lower chamber portion 94 is further in fluid communication with upper chamber portion 76 through an aperture 100. A seat 102 surrounds aperture 100, the seat being engageable by middle diaphragm 56 to seal the aperture 100. A biasing means in the form of a spring 104 is positioned within the lower chamber portion 94 to normally bias the diaphragm out of engagement with seat 102.

Top chamber 48 is divided into upper and lower chamber portions 106 and 108 by top diaphragm 54. Upper chamber portion 106 is in fluid communication with pressurized water source 20 through a conduit 68 which branches from conduit 32. Preferably, conduit 68 has a restrictor element 69 which restricts fluid flow to the upper chamber portion 106 but allows the full fluid pressure of pressurized water source 20 to be developed within the upper chamber portion 106.

The upper chamber portion is also in fluid communication with a passageway 110 in fluid communication with the ambient. A valve 111 is engaged with the passageway 110 and has a valve member 113 movable between an open position allowing fluid flow from the upper chamber portion 106 through passageway 110 and to the ambient and a closed position preventing such flow. The valve 111 has a means for normally biasing the valve member into the closed position and an electrically operated actuator for moving the valve member into the open position in response to the electrical signal from the control system 44 carried over communication link 35, which is connected to the valve 111 as shown in FIG. 3. Preferably, valve 111 comprises an electrically actuated solenoid valve and valve member 113 is an armature of the solenoid which is moved into the open position when the solenoid is energized by the electrical signal from the control system 44.

Preferably, the water pressure within upper chamber portion 106 comprises the means for biasing the valve member 113 into the closed position. Solenoid valve 111 comprises a fluid tight valve chamber 115 which is in fluid communication with upper chamber portion 106. Valve member 113 is positioned within the valve chamber 115 and is biased into the closed position, closing off passageway 110, when the upper chamber portion and the valve chamber are pressurized by the pressurized water source 20 communicated through conduits 32 and 68. When the solenoid valve 111 is electrically actuated by the control system 44, the valve member 113 is moved against the pressure within valve chamber 115 away from the passageway 110 allowing the fluid within the valve chamber 115 and the upper chamber portion 106 to flow through the passageway 110 to the ambient.

An elongated plunger 112 extends between lower chamber portion 108 and upper chamber portion 92 of middle chamber 50. One end 114 of the plunger is engageable with top diaphragm 54. The other end 116 of the plunger is engageable with middle diaphragm 56. The plunger is slidably movable within the housing 46, and the lower chamber portion 108 of the top chamber 48 is isolated from the upper chamber portion 92 by a seal 118 surrounding the plunger 112.

Preferably, the upper chamber portion 92 of the middle chamber 50 vents to the ambient through a reset valve 120 positioned in fluid communication with conduit 42, which has a flow restrictor 43 positioned between the reset value and the piping network 14. Flow restrictor 43 helps isolate the actuator 12 from major pressure fluctuations in the piping network and ensures that upper chamber portion 92 vents rapidly through the reset valve 120 when this valve triggers. Reset valve 120 has a valve body 122 through which a conduit 124 extends providing fluid communication between the upper chamber portion 92 and the ambient. A valve seat 126 is positioned at the end of the conduit 124 which is in fluid communication with the conduit 42, and a valve closing member 128 is movably mounted within the conduit and is movable into sealing engagement with the valve seat 126. In the example shown in FIG. 3, valve closing member 128 is mounted on the end of a shaft 130 which is slidably movable within the valve body 122, although other configurations are also feasible.

Shaft 130 extends outwardly from the valve body 122 and has a knob 132 which may be manually grasped to pull valve closing member 128 into engagement with valve seat 126. A biasing means in the form of spring 134 is positioned around shaft 130 to bias the closing member 128 out of engagement with seat 126. Preferably, conduit 124 is sized larger than the valve closing member over a region 136 between seat 126 and the conduit 42 for reasons explained below.

Low Pressure Electro-Pneumatic AND Gate Actuator Operation

The low pressure electro-pneumatic AND gate actuator 12 according to the invention is used in the preaction fire protection system 10 to reset the system (make it ready for actuation) and to actuate the system upon receipt of the appropriate signals. The appropriate signals preferably comprise a pressure drop in the sprinkler piping network 14 caused by one or more sprinkler heads 16 opening in response to the heat of a fire and an electrical signal from the control system 44 in response to signals from one or more fire detectors 36.

System Reset Function

The sprinkler system 10 is made ready for action by resetting both the electrical and the pneumatic functions of the electro-pneumatic actuator 12.

Water from the pressurized water supply 20 acting through conduits 32 and 68 flows to the upper chamber portion 106 of top chamber 48 and into the valve chamber 115 of solenoid valve 111. Assuming the solenoid valve 111 is energized by a signal from the control system 44, valve member 113 is held in the open position and water flows from the upper chamber portion 106 through passageway 110 to the ambient. The electrical function of the sprinkler system 10 is then reset by removing the signal from the control system 44 to the solenoid valve 111. This releases valve member 113 which moves in response to the water flow through the valve chamber 115 into the closed position preventing further flow of water through passageway 110 to the ambient. Water pressure increases within the valve chamber 115 as well as within upper chamber 106, the pressure securely seating the valve member 113 closed and deflecting the top diaphragm 54 toward the middle chamber 50. The top diaphragm 54 engages end 114 of plunger 112, forcing the opposite plunger end 116 into engagement with the middle diaphragm 56 and causing it to deflect into lower chamber portion 94 against biasing spring 104. Middle diaphragm 56 sealingly engages seat 102 to close the aperture 100 between the lower chamber portion 94 and the adjacent upper chamber portion 76. Air in lower chamber portion 94 is vented to ambient through duct 98 and port 89.

Compressed air is supplied to the actuator 12 from the system air supply 38 through conduit 42. Assuming reset valve 120 is open, the air flows through it to the ambient. To reset the pneumatic function of the electro-pneumatic actuator 12, an operator pulls upwardly on the reset knob 132 on the reset valve 120, moving the valve closing member 128 against biasing spring 134 and seating the valve closing members against valve seat 126. When the valve closing member 128 is in the unseated (open) position as shown in FIG. 3, compressed air normally flows around it due to the enlarged regions 136 of conduit 124. Enlarged conduit region 136 prevents an air pressure surge in the system from unintentionally resetting the system during a fire (and thereby cutting off the water to the sprinkler heads) by inadvertently seating the valve closing member 128. Because of the enlarged conduit region 136, the valve closing member in valve 120 must be held in the seated position until sufficient pressure is achieved within upper chamber 92 and conduit 42 to exert a force on the valve closing member 128 which exceeds the biasing force of spring 134. The spring 134 and valve closing member 128 are designed such that a pressure above about 6.5 psi in upper chamber 92 and conduit 42 is sufficient to keep the valve closing member seated. The reset valve is, thus, used to establish a relatively low pressure trip point for the system as described in more detail below.

With the reset valve 120 closed, air pressure increases in the upper chamber portion 92. This pressure will cause middle diaphragm 56 to deflect into the lower chamber portion 108 forcing it to engage seat 102 and close off aperture 100 independently of the action of the top diaphragm 54 acting through plunger 112 described above. Together the top and middle diaphragms 54 and 56 provide the AND gate logic function of the actuator 12 in that both diaphragms must be allowed to independently deflect to allow the bottom diaphragm 58 to unseat and open aperture 100 to actuate the main valve 18 supplying water to the sprinkler heads as described further below. Either diaphragm alone, however, can exert sufficient force to keep the bottom diaphragm 58 seated and prevent actuation of the system.

Bottom diaphragm 58 is normally biased into engagement with seat 88 by spring 90, thus, sealing hole 86 which would otherwise vent the lower chamber portion 78 to the ambient through port 89. As shown in FIGS. 1 and 2, water pressure taken from upstream of valve 18 through conduit 30 pressurizes the piston 26 within cylinder 28 against spring 27 into engagement with latch 24, keeping clapper 22 closed and cutting water off from the sprinkler piping network 14. The cylinder 28 is in fluid communication with lower chamber portion 78 of actuator 12 through conduit 32 and with upper chamber portion 76 through the small diameter duct 82 fed from conduit 32. Water pressure within the cylinder 28 which keeps clapper 22 closed also forces bottom diaphragm 58 against seat 88 to close hole 86. The water pressure in upper chamber portion 76 exerts greater force on the bottom diaphragm 58 than the same pressure in lower chamber portion 78 since the water pressure in the lower chamber portion 78 does not act over the entire area of the diaphragm as it does in the upper chamber portion 76. This is because the central portion of diaphragm 58 is exposed to atmospheric pressure through hole 86 when the diaphragm 58 is seated against seat 88, and the water pressure within chamber 78 cannot act against this central portion isolated by seat 88.

The system is now set and ready to supply water to sprinkler heads 16 as called for to suppress a fire.

System Actuation

Heat from a fire will cause sprinkler heads 16 on the piping network 14 in the immediate vicinity of the fire to open. This allows compressed air within the piping network to vent to the ambient, causing a pressure drop in the piping network. As shown in FIG. 3, the upper chamber portion 92 of the middle chamber 50 is in fluid communication with the piping network 14 through conduit 42. A pressure drop in the piping network 14 will, thus, be communicated to the chamber portion 92 within the actuator 12.

Concurrently with the opening of sprinkler heads 16, the detectors 36 in the immediate vicinity of the fire will sense the fire and signal the control system 44 through communications link 34. In response, control system 44 sends a signal via communications link 35 to the solenoid valve 111, energizing the solenoid and moving the valve member 113 against the biasing pressure within valve chamber 115 to open the passageway 110 and allow the water within upper chamber portion 106 to flow through the passageway to the ambient, thus, relieving the pressure deflecting the top diaphragm 54 toward the middle chamber 50. This also relieves the force on plunger 112 and allows the middle diaphragm to deflect away from seat 102, thus, opening aperture 100, provided that the air pressure within upper chamber portion 92 is also reduced.

The reduction in air pressure within upper chamber 92 occurs due to the opening of sprinkler heads 16 in response to the fire as described above. When the air pressure in upper chamber portion 92 drops to a predetermined value (preferably about 6.5 psi), the reset valve 120 opens (valve closing element 128 unseats from seat 126 and is biased into enlarged conduit region 136) venting the upper chamber portion 92 to the ambient and causing a rapid pressure drop in the upper chamber portion. As the pressure in upper chamber portion 92 drops, it falls below a second predetermined value which allows biasing spring 104 to deflect both the top and middle diaphragms 54 and 56 upwardly, unseating middle diaphragm 56 from seat 102 and opening aperture 100. This allows water under pressure in upper chamber portion 76 to flow through aperture 100, into lower chamber portion 94 and out to the ambient through duct 98 and port 89. With the water pressure in upper chamber portion 76 thus relieved, the bottom diaphragm 58 is deflected by water pressure within lower chamber portion 78, the bottom diaphragm is unseated from seat 88, allowing water from conduit 32 to vent to the ambient. Deflection of the bottom diaphragm 58 away from seat 88 is ensured by making the diameter 80 of conduit 32 feeding lower chamber portion 78 relatively large as compared with the diameter of duct 82 which feeds the upper chamber portion 76. Despite being at the same pressure, water from conduit 32 cannot flow fast enough through small diameter duct 82 to pressurize upper chamber portion 76 and deflect the bottom diaphragm 58 into engagement with seat 88.

Conduit 32 is in fluid communication with cylinder 28 (see also FIG. 2). Thus, when the conduit 32 is vented to ambient by the action of bottom diaphragm 58, piston 26 is depressurized. This allows spring 27 to move the piston 26 and release latch 24, allowing clapper 22 to open under the pressure of water source 20 and supply water to the piping network 14 where the water is released from the open sprinkler heads 16 onto the fire.

Based upon the foregoing description of the actuator and its operation, it is possible to view the actuator as comprised of a plurality of pressure actuated valves. Bottom chamber 52 and its associated bottom diaphragm 58 comprise an example of a first pressure actuated valve controlling the flow of the pressurized fluid through the actuator. This first valve has a first valve closing member (diaphragm 58) with opposite sides both in fluid communication with the pressurized fluid. The first valve is normally closed and prevents the fluid flow which depressurizes the piston 26. The first valve closing member opens to permit the depressurizing flow when the fluid pressure on one side of the first valve closing member exceeds the fluid pressure on the opposite side of the first valve closing member.

The middle chamber 50 and its middle diaphragm 56 comprise an example of a second pressure actuated valve controlling the fluid pressure on the opposite side of the first valve closing member. The second valve has a second valve closing member (diaphragm 56) which is movable from a closed position, which maintains fluid pressure on the opposite side of the first valve closing member, to an open position, which releases fluid pressure from the opposite side of the first valve closing member. The second valve closing member has a side in fluid communication with a first source of compressed fluid and is movable from the closed to the open position in response to a decrease in pressure of the first source of compressed fluid.

The solenoid valve 111 comprises an example of a third pressure actuated valve. The third pressure actuated valve has a third valve closing member 113 with a mechanical link to the second valve closing member through top diaphragm 54 and plunger 112. The third valve closing member has a side in fluid communication with a source of compressed fluid and is movable from a first position which maintains a force through the mechanical link onto the second valve closing member (thereby maintaining the second valve closing member in the closed position) to a second position removing the force from the second valve closing member. The third valve closing member is electrically actuated and moves to the second position in response to an electrical signal from the control system 44. However, both the third and second valve closing members move into their respective open positions only upon a concurrent pressure decrease in the piping network and an electrical signal to the electropneumatic actuator, as occurs when the piping network 14 is vented when one or more sprinkler heads open and one or more of the detectors 36 send a signal to the control system 44 in the event of a fire. Motion of both the second and third valve closing members allows the first valve closing member to move into its open position and permit flow of the pressurized fluid through the actuator, thereby depressurizing piston 26 and triggering the sprinkler system.

Use of the actuator according to the invention provides the following advantages. The actuator will not trigger the system as a result of an electrical power failure. Second, the sprinkler system may operate at a relatively low air pressure, the air pressure design parameters being chosen independently of the source water pressure needed. This is made possible by controlling the ratio of the area of the middle diaphragm 56 to the cross-sectional area of the aperture 100. By keeping this ratio relatively large, for example, substantially greater than 8/1, a modest air pressure may be used to control a much larger water pressure. Preferably, the ratio is on the order of 20/1 or greater and may range between 20/1 and 700/1 in practical applications. Other ranges of this area ratio, for example, from about 20/1 to about 100/1 or 20/1 to about 600/1 are also useful in practical sprinkler system designs. A preferred embodiment of the actuator uses a ratio of about 528/1. For the various ranges of ratios described above, the system air pressure is effectively independent of the system water pressure. Thus, regardless of the system water pressure (typically 100–120 psi) the system air pressure may be kept relatively low (preferably about 10 psig maximum), and the volume of air in the piping network 14 may be kept to a minimum. This results in less corrosion due to the presence of water vapor in the piping system. Furthermore, water traveling from the source to the sprinkler heads also will arrive sooner because there will be less air under lower pressure to displace out of the system. Third, the actuator acts as an AND gate in a logic circuit in that both the top diaphragm 54 and middle diaphragm 56 must deflect for actuation to occur. Inadvertent depressurization of the piping network, such as may occur if a sprinkler head is damaged, will not trip the system in error. Fourth, unintended resetting of the system, for example, during a fire, is prevented by the use of the reset valve 120, which must be manually held in place until sufficient pressure is achieved to hold the valve closing member 128 seated. This is accomplished by the enlarged conduit region 136 which permits relatively large surges of compressed air to flow without closing the reset valve and shutting down the system. Fifth, the reset valve also eliminates the need for auxiliary means to accelerate system activation since it rapidly depressurizes the chamber portion with which it is associated upon opening.

Figure 4:
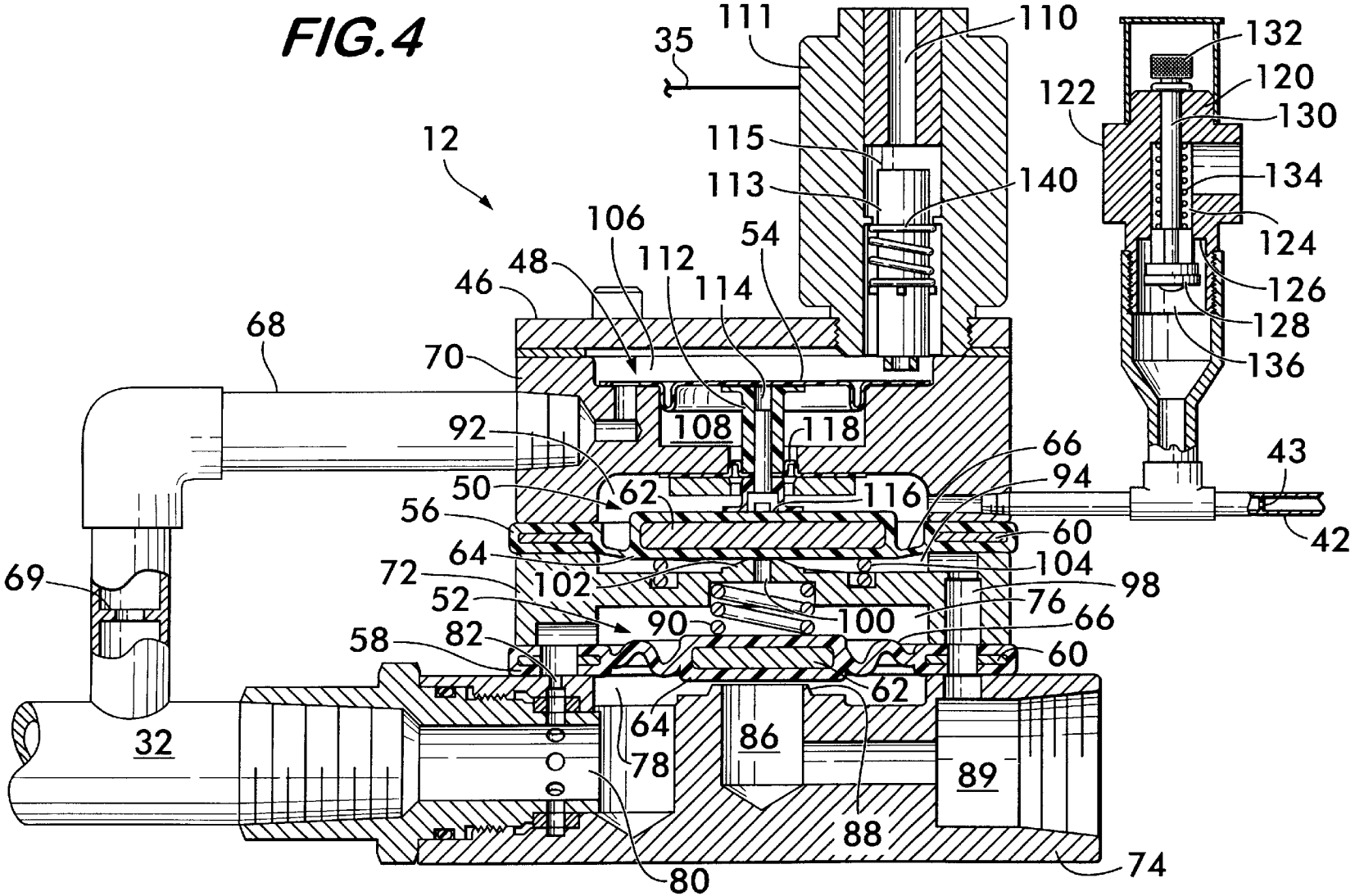
FIG. 4 is a longitudinal sectional view of an alternate embodiment of a low pressure electro-pneumatic AND gate actuator according to the invention.

In an alternate embodiment of the electro-pneumatic actuator 12 shown in FIG. 4, the actuator is modified to operate in a purely pneumatic mode in the event of a power failure. Solenoid actuator 111 is modified so that power supplied to the solenoid holds the valve closing member 113 in a closed position, sealing passageway 110 against the force of a biasing spring 140. Under normal operation, if a true fire condition is present, the proper electric and pneumatic signals will be generated, the electric signal from the control system 44 causing the solenoid 111 to release the valve closing member 113, the valve closing member moving under biasing spring 140 and opening passageway 110 (as shown in FIG. 4) and thereby relieving the pressure in the upper chamber portion 106. The pneumatic signal from the piping network concurrently relieves the pressure in upper chamber portion 92, thereby actuating the sprinkler system 10 as described above.

In the event of a power failure, however, the solenoid 111 releases the valve closing member 113 and spring 140 moves it to open passageway 110, allowing fluid from upper chamber portion 106 to vent to ambient, relieving the pressure in the upper chamber portion 106. Thus, no force is placed on the middle diaphragm 56 by the top diaphragm 54 during a power failure. This condition allows the actuator 12 to respond to a purely pneumatic signal through a pressure drop in piping system 14 transmitted to upper chamber portion 92 through conduit 42 and activate the fire protection sprinkler system. While it is true that the AND gate function of the actuator is lost during a power failure, the system fails safely in that it will still respond to suppress an actual fire condition.

What is claimed is:

1. An electro-pneumatic actuator for depressurizing a piston reciprocable within a cylinder charged with a pressurized first fluid, said actuator adapted to be in fluid communication with a source of pressurized second fluid and comprising:

a first chamber having a flexible first diaphragm mounted therein and sealingly dividing said first chamber into first and second chamber portions, both said chamber portions being in fluid communication with said cylinder, said second chamber portion having an opening providing fluid communication with the ambient, said opening being surrounded by a seat facing said first diaphragm, said first diaphragm being deflectable into sealing engagement with said seat to seal said opening when said cylinder is charged with said first fluid;

a second chamber having a flexible second diaphragm mounted therein and sealingly dividing said second chamber into third and fourth chamber portions, said third chamber portion being in fluid communication with said source of pressurized second fluid, said fourth chamber portion being in fluid communication with the ambient and having an aperture providing fluid communication with said first chamber portion, said aperture being surrounded by a second seat facing said second diaphragm, said second diaphragm being deflectable into sealing engagement with said second seat to seal said aperture when said third chamber portion is pressurized with said second fluid;

a third chamber having a flexible third diaphragm mounted therein and sealingly dividing said third chamber into fifth and sixth chamber portions, said fifth chamber portion being in fluid communication with said pressurized first fluid, an elongated plunger having one end positioned within said sixth chamber portion and engageable with said third diaphragm, the other end of said plunger being positioned within said third chamber portion and engageable with said second diaphragm, said third diaphragm being deflectable into engagement with said one end of said plunger when said fifth chamber portion is pressurized with said pressurized first fluid, said plunger being thereupon forced into engagement with said second diaphragm and thereby forcing said second diaphragm into sealing engagement with said second seat;

a passageway providing fluid communication between said fifth chamber portion and the ambient;

a valve engaged with said passageway and having a valve member movable between an open position allowing fluid flow through said passageway, and a closed position preventing fluid flow through said passageway, said valve further having means for biasing said valve member into one of said closed and open positions and an electrically operated actuator for moving said valve member against said biasing means and into one of said open and closed positions; and said second diaphragm being deflected out of engagement with said second seat only when fluid pressures in both said fifth and said third chamber portions are lowered to respective predetermined values, pressure in said fifth chamber portion being lowered by electrically actuating said valve member into said open position, pressure in said third chamber portion being lowered by a drop in pressure of said pressurized second fluid, upon deflection of said second diaphragm, pressurized first fluid in said first chamber portion being permitted to enter said fourth chamber portion and exit to the ambient, thereby allowing said first diaphragm to deflect out of engagement with said first seat and allowing pressurized first fluid to flow from said cylinder through said second chamber portion and exit to the ambient, thereby depressurizing said piston and allowing it to move within said cylinder.

2. An electro-pneumatic actuator according to claim 1, wherein said valve comprises a solenoid having a valve chamber in fluid communication with said fifth chamber portion and said passageway, said valve member comprising an armature of said solenoid movable within said valve chamber, said valve member being biased into said closed position by said pressurized first fluid within said valve chamber and movable into said open position when electrical current is supplied to actuate said solenoid, thereby lowering pressure in said fifth chamber portion by allowing said pressurized first fluid to flow through said passageway to the ambient.

3. An electro-pneumatic actuator according to claim 2, wherein said pressurized first fluid comprises a liquid and said pressurized second fluid comprises a gas.

4. An electro-pneumatic actuator according to claim 3, further comprising a reset valve comprising:

a valve body;

a conduit extending through said valve body having one end in fluid communication with said third chamber portion and the other end vented to the ambient;

a valve seat positioned in said one end of said conduit;

a valve closing member movably mounted within said conduit adjacent to said seat and movable into sealing engagement with said seat to close said reset valve; and means for biasing said valve closing member out of engagement with said seat when fluid pressure within said one end of said conduit falls below a predetermined value, thereby opening said reset valve and venting said third chamber portion to the ambient.

5. An electro-pneumatic actuator according to claim 4, wherein said reset valve further comprises a manual reset knob attached to said valve closing member and extending from said valve body, said manual reset knob being manually movable to move said valve closing member against said biasing means into engagement with said valve seat thereby closing said conduit, said valve closing member remaining engaged with said seat as long as fluid pressure within said one end of said conduit is above said predetermined value.

6. An electro-pneumatic actuator according to claim 5, wherein said valve closing member is positioned between said valve seat and said third chamber portion, said one end of said conduit between said valve seat and said third chamber portion being sized relatively larger than said valve closing member thereby allowing fluid to flow around said valve closing member and through said conduit when said valve closing member is not engaged with said seat regardless of the fluid pressure within said conduit.

7. An electro-pneumatic actuator according to claim 6, wherein said biasing means comprises a spring positioned within said conduit downstream of said valve closing member, said spring engaging said valve closing member and having a predetermined spring constant for biasing said valve closing member out of engagement with said valve seat when fluid pressure within said one end of said conduit falls below a predetermined value.

8. An electro-pneumatic actuator according to claim 3, wherein said predetermined value of fluid pressure is between about 4 psi and about 10 psi.

9. An electro-pneumatic actuator according to claim 8, wherein said predetermined value of fluid pressure is about 6.5 psi.

10. An electro-pneumatic actuator according to claim 1, wherein said valve comprises a solenoid having a valve chamber in fluid communication with said fifth chamber portion and said passageway, said valve member comprising an armature of said solenoid movable within said valve chamber and a biasing spring engaging said armature, said valve member being movable into said closed position when electrical current is supplied to said solenoid, and biased into said open position by said biasing spring in the absence of said electrical current thereby lowering pressure in said fifth chamber portion by allowing said pressurized first fluid to flow through said passageway to the ambient.

11. An electro-pneumatic actuator according to claim 1, further comprising a biasing means positioned within said first chamber, said biasing means engaging and biasing said first diaphragm into engagement with said seat.

12. An electro-pneumatic actuator according to claim 1, further comprising a biasing means positioned within said second chamber, said biasing means engaging and biasing said second diaphragm away from said second seat.

13. An electro-pneumatic actuator according to claim 1, wherein said sixth chamber portion is in fluid communication with the ambient.

14. An electro-pneumatic actuator according to claim 1, wherein said aperture providing fluid communication between said first and said fourth chamber portions has a substantially smaller cross-sectional area than the area of said second diaphragm, thereby allowing a relatively low fluid pressure on one side of said second diaphragm opposite to said aperture to deflect said aperture into engagement with said second seat against a relatively higher fluid pressure in said first chamber portion.

15. An electro-pneumatic actuator according to claim 14, wherein the area of said second diaphragm is relatively larger than the cross-sectional area of said aperture so as to allow the fluid pressure necessary to maintain said second diaphragm seated against said second seat against fluid pressure within said first chamber portion to be established substantially independently of the pressure of said fluid in said first chamber portion.

16. An electro-pneumatic actuator according to claim 15, wherein the ratio of said area of said second diaphragm to said cross-sectional area of said aperture is greater than about 20/1.

17. An electro-pneumatic actuator according to claim 16, wherein the ratio of said area of said second diaphragm to said cross-sectional area of said aperture is between about 20/1 and about 700/1.

18. An electro-pneumatic actuator according to claim 17, wherein the ratio of said area of said second diaphragm to said cross-sectional area of said aperture is between about 20/1 and about 100/1.

19. An electro-pneumatic actuator according to claim 17, wherein the ratio of said area of said second diaphragm to said cross-sectional area of said aperture is between about 20/1 and about 600/1.

20. An electro-pneumatic actuator according to claim 1, further comprising:

a first duct providing said fluid communication between said cylinder and said second chamber portion, said first duct having a first diameter; and a second duct connected between said first duct and said first chamber portion, said second duct having a second diameter relatively smaller than said first diameter and operating to restrict fluid flow into said first chamber relative to said second chamber.

21. An electro-pneumatic actuator for actuating a system triggered by a flow of a pressurized first fluid, said electropneumatic actuator being in fluid communication with a source of pressurized second fluid and a source of electrical current, said electro-pneumatic actuator comprising:

a first pressure actuated valve controlling a flow of said pressurized first fluid through said actuator, said first valve having a first valve closing member with oppositely disposed sides both in fluid communication with said pressurized first fluid and being normally closed and preventing said flow, said first valve closing member opening to permit said flow when fluid pressure on one side of said first valve closing member exceeds fluid pressure on the opposite side of said first valve closing member, thereby actuating said system;

a second pressure actuated valve controlling the fluid pressure on said opposite side of said first valve closing member, said second pressure actuated valve having a second valve closing member movable from a closed position which maintains fluid pressure on said opposite side of said first valve closing member, to an open position which releases fluid pressure from said opposite side of said first valve closing member, said second valve closing member having a side in fluid communication with said source of pressurized second fluid and being movable from said closed to said open position in response to a decrease in pressure of said pressurized second fluid;

a third pressure actuated valve having a third valve closing member and a mechanical link to said second valve closing member, said third pressure actuated valve being in fluid communication with said source of pressurized first fluid, said third valve closing member being biased by said pressurized first fluid into a closed position maintaining a force through said mechanical link onto said second valve closing member, thereby maintaining said second valve closing member in said closed position, said third pressure actuated valve further comprising an electrically operated actuator adapted to move said third valve closing member, upon a change in said electrical current, to an open position allowing said pressurized first fluid to flow from said third pressure, actuated valve and thereby releasing said force from said second valve closing member; and both said third and second valve closing members moving into their respective open positions only upon a concurrent pressure decrease of said second source of compressed fluid and said change in said electrical current, thereby allowing said first valve closing member to move into said open position and permit flow of said pressurized fluid through said actuator, thereby triggering said system.

22. An electro-pneumatic actuator according to claim 21, wherein said first pressure actuated valve comprises a first chamber and said first valve closing member comprises a first diaphragm positioned within and sealingly dividing said first chamber into first and second chamber portions, said pressurized first fluid being in fluid communication with both said chamber portions, one of said chamber portions having a opening providing fluid communication with the ambient and closable by said first diaphragm.

23. An electro-pneumatic actuator according to claim 22, wherein said second pressure actuated valve comprises a second chamber and said second valve closing member comprises a second diaphragm positioned within and sealingly dividing said second chamber into third and fourth chamber portions, said second chamber portion being in fluid communication with said source of pressurized second fluid, said fourth chamber portion having an aperture providing fluid communication with said second chamber portion and closable by said second diaphragm moving into said closed position.

24. An electro-pneumatic actuator according to claim 23, wherein said mechanical link comprises a third chamber and a third diaphragm positioned within and sealingly dividing said third chamber into fifth and sixth chamber portions, said pressurized first fluid being in fluid communication said fifth chamber portion, said mechanical link further comprising a plunger being slidably mounted between said sixth and said third chamber portions and mechanically attaching said third diaphragm to said second diaphragm such that deflection of said third diaphragm toward said second diaphragm causes deflection of said second diaphragm toward said fourth chamber portion into said closed position.

25. An electro-pneumatic actuator according to claim 24, wherein said third pressure actuated valve comprises a solenoid having a valve chamber in fluid communication with said fifth chamber portion, said third valve closing member comprising an armature of said solenoid movable within said valve chamber between a closed position maintaining pressure of said pressurized first fluid within said fifth chamber portion, and an open position releasing said pressurized first fluid from said fifth chamber portion, said third valve closing member being biased into said closed position by said pressurized first fluid within said valve chamber and movable into said open position when electrical current is supplied to actuate said solenoid.

26. An electro-pneumatic actuator according to claim 25, wherein the ratio of said area of said second diaphragm to said cross-sectional area of said aperture is greater than about 20/1.

27. An electro-pneumatic actuator according to claim 26, wherein the ratio of said area of said second diaphragm to said cross-sectional area of said aperture is between about 20/1 and about 700/1.

28. An electro-pneumatic actuator according to claim 27, wherein the ratio of said area of said second diaphragm to said cross-sectional area of said aperture is between about 20/1 and about 100/1.

29. An electro-pneumatic actuator according to claim 27, wherein the ratio of said area of said second diaphragm to said cross-sectional area of said aperture is between about 20/1 and about 600/1.

30. An electro-pneumatic actuator for controlling a flow of a pressurized first fluid in response to a pressure drop of a pressurized second fluid and an electrical signal, said actuator comprising:

a first valve adapted to be in fluid communication with said first fluid, said first valve being openable by decreasing first fluid pressure within said first valve to allow flow of said first fluid therethrough, said first valve being normally closed;

a second valve being in fluid communication with said first valve, said second valve being openable to allow flow of a portion of said first fluid from said first valve thereby decreasing said first fluid pressure within and opening said first valve, said second valve being adapted to be in fluid communication with said second fluid and openable by decreasing second fluid pressure within said second valve; and a third valve adapted to be in fluid communication with said first fluid and having a mechanical linkage connected to said second valve for maintaining said second valve closed, said linkage releasing said second valve in response to a decrease in pressure of said first fluid within said third valve, said third valve being openable in response to an electric signal to allow flow of said first fluid from said third valve thereby to decreasing said first fluid pressure therein.

31. An electro-pneumatic actuator according to claim 30, wherein said first valve comprises:

a first chamber;

a first diaphragm dividing said first chamber into first and second chamber portions;

a first duct for providing fluid communication between said pressurized first fluid and said first chamber portion;

a second duct for providing fluid communication between said pressurized first fluid and said second chamber portion, said second duct having a larger diameter than said first duct;

an opening in said first chamber providing fluid communication between said second chamber portion and the ambient; and a first seat surrounding said opening, said first diaphragm being deflectable to sealingly engage said first seat thereby closing said first valve, said first diaphragm being deflectable by pressure of said first fluid in said second chamber.

32. An electro-pneumatic actuator according to claim 31, wherein said second valve comprises:

a second chamber;

a second diaphragm dividing said second chamber into third and fourth chamber portions, an aperture in said second chamber, said aperture providing fluid communication between said fourth chamber portion and said first chamber portion;

a second seat positioned within said fourth chamber portion surrounding said aperture, said second diaphragm being deflectable to sealingly engage said second seat thereby closing said second valve; and a conduit for providing fluid communication between said third chamber portion and said pressurized second fluid, said second diaphragm being deflectable by pressure of said second fluid in said third chamber portion.

33. An electro-pneumatic actuator according to claim 32, wherein said third valve comprises:

a third chamber;

a third diaphragm dividing said third chamber into fifth and sixth chamber portions, said fifth chamber portion being adapted to be in fluid communication with said pressurized first fluid;

a plunger having a first end engaging said third diaphragm and a second end engaging said second diaphragm, said plunger being movably mounted between said sixth and said third chamber portions linking said second and third diaphragms together so that deflection of said third diaphragm causes deflection of said second diaphragm;

a passageway connecting said fifth chamber portion to the ambient;

a fluid tight valve chamber in fluid communication with said fifth chamber portion and said passageway;

a valve member positioned within said valve chamber and movable between an open position permitting said first fluid to flow from said fifth chamber portion through said passageway, and a closed position preventing flow through said passageway, said valve member being biased into one of said open and closed positions; and a solenoid operatively associated with said valve member, said solenoid for moving said valve member into one of said open and closed positions upon receipt of an electrical signal.

34. An electro-pneumatic actuator according to claim 33, wherein said valve member is biased into said closed position by pressure of said first fluid within said valve chamber, said solenoid moving said valve member into said open position upon receipt of an electrical signal.

35. An electro-pneumatic actuator according to claim 33, further comprising a biasing spring engaging said valve member for biasing said valve member into said open position, said solenoid moving said valve member into said closed position and releasing said valve member to be biased into said open position upon receipt of an electrical signal, as well as in the absence of electrical power to said solenoid.

36. A sprinkler system for fire suppression, said sprinkler system comprising:

a source of pressurized water;

a source of pressurized gas;

a piping network in fluid communication with said source of pressurized water and said source of pressurized gas, said piping network comprising a plurality of heat actuated sprinkler heads mounted thereon which open in response to a fire proximate to said heads for discharging said water from said piping network;

a plurality of fire detectors substantially co-located with said sprinkler heads, said detectors providing electrical signals in response to a fire proximate to said detectors;

a control system for receiving said electrical signals and generating a second electrical signal in response thereto;

a valve positioned between said water source and said piping network, said valve being normally closed and preventing water flow from said water source to said piping network, said piping network normally being pressurized by said gas;

a cylinder in fluid communication with said water source;

a piston reciprocable within said cylinder and operatively associated with said valve, pressure from said water source within said cylinder biasing said piston into engagement with said valve and thereby maintaining said valve closed;

an electro-pneumatic actuator for depressurizing said piston and thereby opening said valve, said electro-pneumatic actuator comprising:

a first valve in fluid communication with said water source, said first valve being openable by a decrease in water pressure within said first valve to allow flow of water therethrough, said first valve being normally closed;

a second valve in fluid communication with said first valve, said second valve being openable to allow flow of a portion of said water from said first valve, thereby decreasing said water pressure within and opening said first valve, said second valve being in fluid communication with said source of compressed gas and openable by a decrease in gas pressure within said second valve;

a third valve in fluid communication with said water source and having a mechanical linkage connected to said second valve for maintaining said second valve closed, said linkage releasing said second valve in response to a decrease in water pressure within said third valve, said third valve being openable in response to said second electrical signal generated by said control system to allow flow of water from said third valve; and said first valve being opened to depressurize said piston when one or more of said sprinkler heads open substantially concurrently with one or more of said detectors generating an electrical signal, said sprinkler heads opening thereby decreasing gas pressure within said second valve, said second signal generated by said control system opening and thereby decreasing water pressure within said third valve, said decreasing gas and water pressure in said second and third valves allowing said second valve to open, thereby allowing said first valve to open and depressurize said piston, upon being depressurized said piston moving within said cylinder and releasing said valve, said valve moving into an open position allowing water to flow from said water source to said piping network and be discharged through said open sprinkler heads.

* * * * *